US007555913B2

(12) United States Patent
Hwang et al.

(10) Patent No.: US 7,555,913 B2
(45) Date of Patent: Jul. 7, 2009

(54) METHOD FOR CONTROLLING MULTIPLE COMPRESSORS ACCORDING TO A MATRIX

(75) Inventors: Yoon Jei Hwang, Seoul (KR); Cheol Min Kim, Anyang-si (KR); Chang Min Choi, Seoul (KR); Yeong Seop Choe, Buchun-si (KR)

(73) Assignee: LG Electronics Inc., Seoul (KR)

( * ) Notice: Subject to any disclaimer, the term of this patent is extended or adjusted under 35 U.S.C. 154(b) by 343 days.

(21) Appl. No.: 11/138,256

(22) Filed: May 27, 2005

(65) Prior Publication Data

US 2005/0262860 A1 Dec. 1, 2005

(30) Foreign Application Priority Data

May 28, 2004 (KR) ..... 10-2004-0038221

(51) Int. Cl.
*F25B 1/00* (2006.01)
*F25B 49/00* (2006.01)
*F25B 7/00* (2006.01)
*F25B 1/10* (2006.01)

(52) U.S. Cl. ..... 62/228.5; 62/175; 62/510; 62/228.1

(58) Field of Classification Search ..... 62/228.1, 62/228.5, 510, 196.2, 175; 417/7, 17
See application file for complete search history.

(56) References Cited

U.S. PATENT DOCUMENTS 4,384,462 A * 5/1983 Overman et al. ..... 62/175
4,580,947 A 4/1986 Shibata et al.
4,951,475 A * 8/1990 Alsenz ..... 62/117
5,123,256 A * 6/1992 Oltman ..... 62/175
5,231,846 A * 8/1993 Goshaw et al. ..... 62/175
6,540,148 B1 * 4/2003 Salsbury et al. ..... 236/1 EA
6,807,816 B2 10/2004 Lee et al.

(Continued)

FOREIGN PATENT DOCUMENTS

CN 1435604 8/2003

(Continued)

OTHER PUBLICATIONS

An English language Abstract of the corresponding Japanese Laid-Open Patent Publication No. 2003-222368.

(Continued)

*Primary Examiner*—Chen-Wen Jiang
(74) *Attorney, Agent, or Firm*—Birch, Stewart, Kolasch & Birch, LLP

(57) ABSTRACT

A method for controlling multiple compressors for use in an airconditioner is disclosed. In the airconditioner having N compressors, the method sequentially and equally operates the N compressors using a two-dimensional matrix which prevents only a specific compressor from among the N compressors from being repeatedly operated, arranges rows and columns of the two-dimensional matrix to allow all compressors to be alternately operated according to the number of operating compressors from among all compressors, and stochastically operates and stops the N compressors using the two-dimensional matrix. As a result, the method controls the N compressors to be equally operated without overlapping operation times of the N compressors, and alleviates fatigue of the compressors, resulting in equally longer lifetimes of the N compressors.

5 Claims, 4 Drawing Sheets

U.S. PATENT DOCUMENTS

| | | | | |
|---|---|---|---|---|
| 6,843,425 | B2 | 1/2005 | Lee | |
| 2004/0098993 | A1 | 5/2004 | Lee | |
| 2005/0092000 | A1 | 5/2005 | Hwang et al. | |
| 2005/0262860 | A1 * | 12/2005 | Hwang et al. | 62/228.5 |

FOREIGN PATENT DOCUMENTS

| | | |
|---|---|---|
| DE | 2758153 | 7/1979 |
| DE | 3543707 | 6/1987 |
| DE | 3832037 | 3/1990 |

OTHER PUBLICATIONS

U.S. Appl. No. 11/095,563 to Lee et al., which was filed on Apr. 1, 2005.
English Language Abstract of DE 38 32 037.
English Language Abstract of DE 35 43 707.

* cited by examiner

FIG. 4 column increase → row increase ↓

| | j = 0 | j = 1 | j = 2 | j = 3 | j = 4 |
|---|---|---|---|---|---|
| | no operating compressor | Drive one operating compressor | Drive two operating compressors | Drive three operating compressors | Drive four operating compressors |
| | 1234 | 1234 | 1234 | 1234 | 1234 |
| i = 0 | 0000 | $1000_2$ $(2^{+1})$ | $1100_2$ $(2^{+1}+2^{+2})$ | $1110_2$ $(2^{+1}+2^{+2}+2^{+3})$ | $1111_2$ $(2^{+1}+2^{+2}+2^{+3}+2^{+4})$ |
| i = 1 | 0000 | $0100_2$ $(2^{+2})$ | $0110_2$ $(2^{+2}+2^{+3})$ | $0111_2$ $(2^{+2}+2^{+3}+2^{+4})$ | $1111_2$ $(2^{+2}+2^{+3}+2^{+4}+2^{+1})$ |
| i = 2 | 0000 | $0010_2$ $(2^{+3})$ | $0011_2$ $(2^{+3}+2^{+4})$ | $1011_2$ $(2^{+3}+2^{+4}+2^{+1})$ | $1111_2$ $(2^{+3}+2^{+4}+2^{+1}+2^{+2})$ |
| i = 3 | 0000 | $0001_2$ $(2^{+4})$ | $1001_2$ $(2^{+4}+2^{+1})$ | $1101_2$ $(2^{+4}+2^{+1}+2^{+2})$ | $1111_2$ $(2^{+4}+2^{+1}+2^{+2}+2^{+3})$ |

n : the number of overall compressors of system i : row j : column $X_{ij}$ : compressor operation value of array having i-row and j-column

* 0 : COMP OFF
* 1 : COMP ON

METHOD FOR CONTROLLING MULTIPLE COMPRESSORS ACCORDING TO A MATRIX

BACKGROUND OF THE INVENTION

1. Field of the Invention

The present invention relates to an apparatus and method for controlling multiple compressors (also called a multi-compressor) contained in an airconditioner, and more particularly to an apparatus and method for operating multiple compressors contained in an airconditioner, which stochastically operates or stops N compressors using a two-dimensional matrix, controls the N compressors to be equally operated without overlapping individual operation times of the N compressors, and alleviates fatigue of the compressors, such that the N compressors have longer lifetimes.

2. Description of the Related Art

Generally, airconditioners have been adapted to cool or heat a room using a cooling cycle of a refrigerant compressed at high temperature and high pressure.

The compressor includes a compressor having a compressor chamber for compressing a refrigerant, and a motor unit for varying the number of operating compressors. With the increasing demands of large-capacity airconditioners and multifunctional airconditioners, the above-mentioned compressor includes two or more multi-compressors, such that the airconditioner changes the number of operating compressors according to an indoor load condition, and at the same time operates the determined compressors.

FIG. 1 is a block diagram illustrating a conventional airconditioner having four compressors.

Referring to FIG. 1, the conventional airconditioner having four compressors includes: an indoor heat exchanger 11 which is arranged indoors, and cools/heats room air; an outdoor heat exchanger 12 which is arranged outdoors, and is heat-exchanged with outdoor air; a refrigerant conduit 17 for connecting the indoor heat exchanger 11 to the outdoor heat exchanger 12; first to fourth compressors 10, 20, 30, and 40; a common accumulator for accumulating a liquid refrigerant to control the first to fourth compressors 10, 20, 30, and 40 to receive only a gas refrigerant; a four-way valve which is connected to the first to fourth compressors 10, 20, 30, and 40, and switches a flow passage to transmit the refrigerant to one of the indoor and outdoor heat exchangers 11 and 12; and an expander 13 which is arranged between the indoor heat exchanger 11 and the outdoor heat exchanger 12, and expands the refrigerant passing through the indoor and outdoor heat exchangers 11 and 12 at low temperature and low pressure.

If the above-mentioned airconditioner having four compressors performs a cooling operation and has the highest indoor load, a controller operates all of the first to fourth compressors 10, 20, 30, and 40, transmits a high-temperature and high-pressure refrigerant generated from the first to fourth compressors 10, 20, 30, and 40 to the outdoor heat exchanger 12, controls the refrigerant received from the outdoor heat exchanger 12 to be heat-exchanged with outdoor air, condenses the high-temperature and high-pressure gas refrigerant into a liquid refrigerant, and transmits the liquid refrigerant to the expander 13. Upon receiving the liquid refrigerant, the expander 13 expands the received liquid refrigerant at low temperature and low pressure, and transmits the expanded refrigerant to the indoor heat exchanger 11. The indoor heat exchanger 11 absorbs peripheral heat of the received refrigerant, such that the refrigerant is evaporated. In the meantime, the refrigerant received from the indoor heat exchanger 11 is transmitted to the common accumulator 15 via the four-way valve, and circulates the first to fourth compressors 10, 20, 30, and 40, resulting in a cooling cycle.

In this case, if indoor load is lowered, the controller sequentially stops the fourth compressor 40, the third compressor 30, and the second compressor 20 from among the four compressors 10, 20, 30, and 40. Otherwise, if the amount of indoor load is increased, the controller sequentially drives the first compressor 10, the second compressor 20, the third compressor 30, and the fourth compressor 40.

Therefore, if the airconditioner performs a cooling operation and has the lowest indoor load, the controller operates only the first compressor 10 from among four compressors 10, 20, 30, and 40, and commands the refrigerant discharged from the first compressor 10 to circulate the outdoor heat exchanger 12, the expander 13, the indoor heat exchanger 11, and the first compressor 10, such that the indoor heat exchanger 11 can act as a cooler.

Otherwise, in the case of a heating operation, the controller allows the refrigerant to be counter-circulated in the above-mentioned cooling cycle.

However, if the conventional airconditioner including four compressors 10, 20, 30, and 40 has the highest load in response to indoor load, it operates all four compressors, such that the four compressors experience the same fatigue. Otherwise, if the conventional airconditioner operates only some compressors from among the four compressors, the fourth compressor 40 is not operated whereas the first compressor 10 is continuously operated, and the first to fourth compressors 10, 20, 30, and 40 have different operation times according to the degree of indoor load, such that eccentric fatigue may occur in one of the four compressors.

Also, some compressors are continuously operated, such that their lifetimes may be considerably shorter than those of the remaining compressors.

SUMMARY OF THE INVENTION

Therefore, the present invention has been made in view of the above problems, and it is an object of the invention to provide an apparatus and method for operating multiple compressors (also called a multi-compressor) contained in an airconditioner, which alternately operates N compressors contained in the airconditioner, and controls the N compressors to be equally operated without overlapping operation times of the N compressors, such that individual lifetimes of the N compressors are equally increased.

In accordance with one aspect of the present invention, these objects are accomplished by providing an apparatus for controlling multiple compressors for use in an airconditioner comprising: a temperature sensor for detecting a room temperature; and a controller for receiving an electric signal from the temperature sensor, comparing a current indoor load with a reference indoor load, and allowing all compressors to be sequentially and alternately operated by a predetermined matrix when a load variation occurs.

In accordance with another aspect of the present invention, there is provided a method for controlling multiple compressors for use in an airconditioner including N compressors comprising the step of: a) sequentially and equally operating the N compressors according to a matrix defined to prevent only a specific compressor from among the N compressors from being repeatedly operated, wherein rows and columns of the matrix are arranged to control the N compressors to be alternately operated according to the number of operating compressors from among the N compressors.

Preferably, the matrix is indicative of a two-dimensional matrix.

Preferably, the method further comprises the steps of: b) deciding to increase or decrease capacity of the operating compressors by a predetermined value of k such that k compressors can be added or subtracted to/from the N compressors; c) changing a position of the matrix including one or more numbers indicative of a current operation state to another position according to the determined result; and d) changing operation states of the N compressors to other states according to a number located at the changed matrix position.

Preferably, the matrix including one or more numbers indicative of the current operation state is a two-dimensional matrix including a plurality of rows from 0 to n−1 and a plurality of columns from 0 to n.

Preferably, the method further comprises the step of: if the capacity of the operating compressors must be increased by the predetermined value of k such that k compressors can be added to the N compressors at the step (b), determining the position of the changed matrix of the step (c) by increasing a column value from an initial position by the predetermined value of k.

Preferably, the method further comprises the step of: if the capacity of the operating compressors must be decreased by the predetermined value of k such that k compressors can be subtracted from the N compressors at the step (b), determining the position of the changed matrix of the step (c) by increasing a row value by 1 and decreasing a column value by k on the basis of an initial position.

Preferably, operation states of the operating compressors and stop states of stationary compressors are denoted by cipher information of a binary number equal to a serial number of each compressor, each of the operating compressors is denoted by '1', and each of the stationary compressors is denoted by '0' in such a way that a binary number having N ciphers indicates the operation and stationary compressors.

Preferably, elements of the two-dimensional matrix are obtained by converting a numerical value acquired by the following expression into a binary number,

[Expression]

$$Xij=\text{sum from } \{k=1\} \text{ to } \{j\} \{2^{n-a}\}$$

Where, if $k+1 \leqq n$, $a=k+i$, and if $k+1>n$, $a=(k+i)-n$,

But, if $j=0$, $Xij=0$ where n=the number of overall compressors of a system i=row j=column Xij=compressor operation value of an array having an i-row and a j-column The apparatus and method for controlling multiple compressors for use in an airconditioner sequentially and equally operates N compressors using a predetermined matrix which prevents only a specific compressor from among the N compressors from being repeatedly operated, arranges rows and columns of the matrix to allow all compressors to be alternately operated according to the number of operating compressors from among all compressors, and stochastically operates and stops the N compressors using the matrix. As a result, the present invention controls the N compressors to be equally operated without overlapping operation times of the N compressors, and alleviates fatigue of the compressors, such that the N compressors have equally longer lifetimes.

BRIEF DESCRIPTION OF THE DRAWINGS

The above objects, and other features and advantages of the present invention will become more apparent after reading the following detailed description when taken in conjunction with the drawings, in which:

FIG. 4 shows a two-dimensional matrix for controlling four compressors contained in the airconditioner according to the present invention.

DESCRIPTION OF THE PREFERRED EMBODIMENTS

Figure 1:
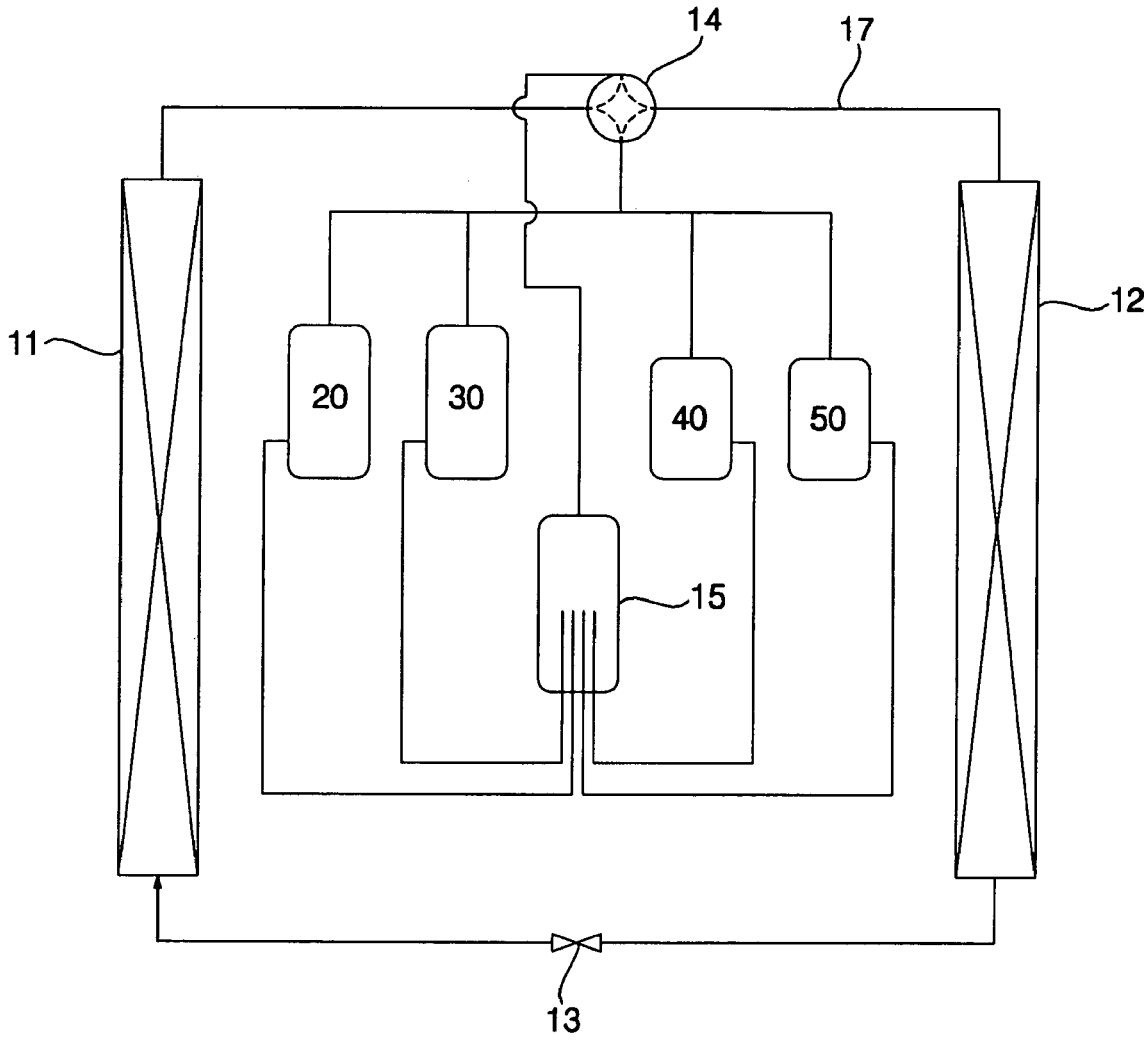
FIG. 1 (Prior Art)
FIG. 1 is a block diagram illustrating a conventional airconditioner having four compressors.

Now, preferred embodiments of the present invention will be described in detail with reference to the annexed drawings. In the drawings, the same or similar elements are denoted by the same reference numerals even though they are depicted in different drawings. In the following description, a detailed description of known functions and configurations incorporated herein will be omitted when it may make the subject matter of the present invention rather unclear.

An apparatus and method for controlling a multi-compressor for use in an airconditioner according to the present invention will hereinafter be described with reference to the annexed drawings.

Prior to describing the present invention, it should be noted that a plurality of methods for controlling multiple compressors (i.e., a multi-compressor) for use in an airconditioner may exist as necessary.

Figure 2:
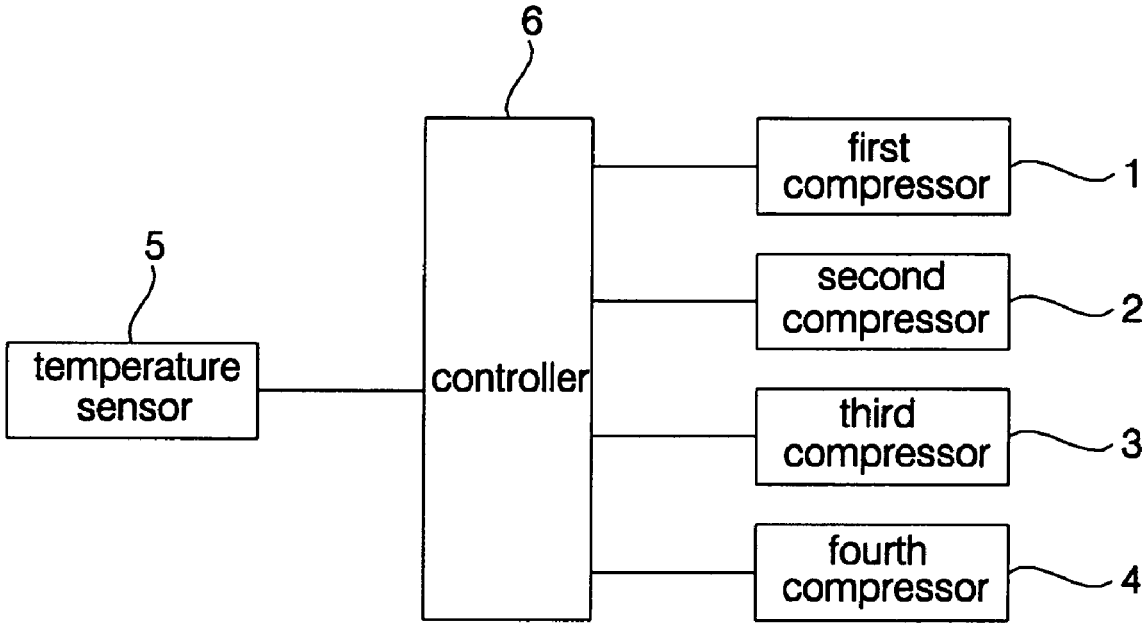
FIG. 2 is a block diagram illustrating an apparatus for controlling four compressors contained in an airconditioner according to the present invention.

FIG. 2 is a block diagram illustrating an apparatus for controlling 4 compressors contained in an airconditioner according to the present invention.

As shown in FIG. 2, an apparatus for controlling a multi-compressor for use in the airconditioner includes a temperature sensor 5 installed at one side of a room to detect a room temperature; and a controller 6 for receiving an electric signal from the temperature sensor 5, comparing a current indoor load with a reference indoor load, determining a correct indoor load state, and transmitting operation and stop signals to first to fourth compressors 1, 2, 3, and 4 according to the determined indoor load state.

The controller 6 compares a temperature detected by the temperature sensor 5 with a predetermined temperature to determine an indoor load state, and sequentially and alternately operates the first to fourth compressors 1, 2, 3, and 4 according to a predetermined matrix when a load variation arises.

Figure 3:
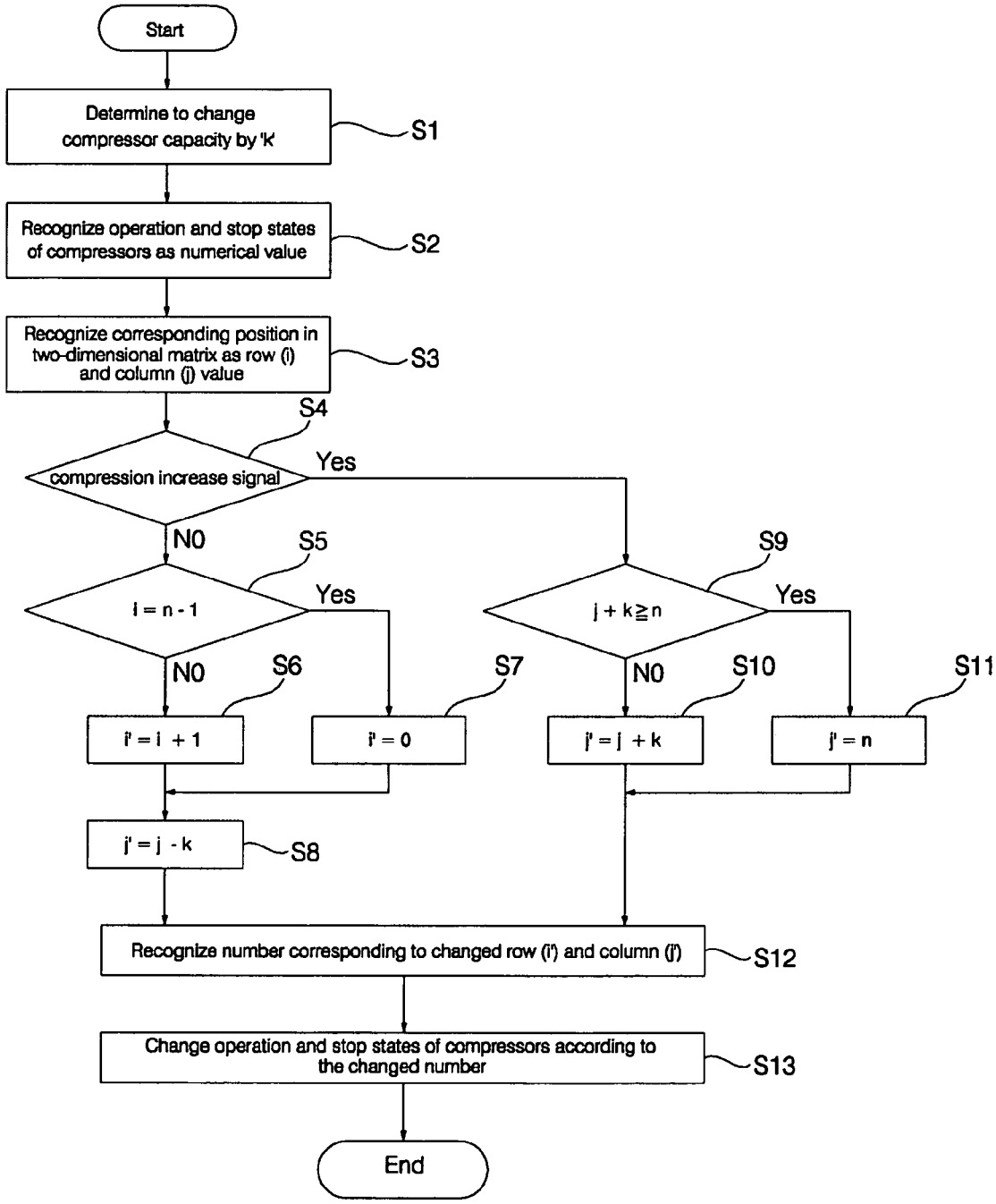
FIG. 3 is a flow chart illustrating a method for controlling the airconditioner including four compressors according to the present invention.

FIG. 3 is a flow chart illustrating a method for controlling the airconditioner including four compressors according to the present invention. FIG. 4 shows a two-dimensional matrix for controlling four compressors contained in the airconditioner according to the present invention.

A method for controlling a multi-compressor for use in an airconditioner sequentially and equally operates four compressors 1, 2, 3, and 4 using a predetermined matrix, such that it prevents only a specific compressor from among the four compressors from being repeatedly operated. In this case, a row and a column of the matrix are arranged to allow all compressors 1~4 to be alternately operated according to the number of overall operating compressors.

The above-mentioned matrix is a two-dimensional matrix.

Referring to FIG. 3, the controller 6 compares a room temperature detected by the temperature sensor 5 with a reference temperature, and increases or decreases capacity of operating compressors by a predetermined value of k according to the compared result such that k compressors can be added or subtracted to/from all compressors at step S1.

The controller 6 changes the position of a matrix indicative of a current operation state to another position according to the determined result of the above step S1, such that the controller recognizes operation and stop states of N compressors as numerical information at step S2. In this case, operation states of the operating compressors and stop states of the stationary compressors are denoted by a number of ciphers of a binary number equal to a serial number of each compressor. In more detail, the operating compressor is denoted by '1', and the stationary compressor is denoted by '0' in such a way that a binary number having N ciphers indicates the operating and stationary compressors. For example, if only the second and third compressors 2 and 3 are operated in the case of using an airconditioner having 4 compressors, this condition is denoted by a predetermined number '01102'.

The controller 6 searches for a specific position corresponding to the above number '01102' from among a two-dimensional matrix denoted by the following expression, and recognizes a row (i) and a column (j) of the specific position at step S3.

$$Xij=\text{sum from } \{k=1\} \text{ to } \{j\} \{2^{n-a}\}$$

Where, if $k+1 \leqq n$, $a=k+i$, and if $k+1>n$, $a=(k+i)-n$,

But, if $j=0$, $Xij=0$ where n=the number of overall compressors of a system i=row j=column Xij=compressor operation value of an array having an i-row and a j-column In this case, a two-dimensional matrix indicative of the operation state includes rows from 0 to n−1 and columns from 0 to n. For example, if an airconditioner includes four compressors, a two-dimensional matrix shown in FIG. 4 is configured.

If the controller 6 decides to increase the compressor capacity by a predetermined value of k at step S4, it determines whether a row (i) indicative of a current operation state is equal to 'n−1' at step S5. If the row (i) is equal to 'n−1' as denoted by i=n−1 at step S5, the controller 6 sets a changed row (i') to i+1 as denoted by i'=i+1 at step S6. Otherwise, if the row (i) is different from 'n−1' at step S5, the controller 5 sets the changed row (i') to '0' as denoted by i'=0 at step S7. In the above-mentioned two cases, the controller 6 sets a changed column (j') to a predetermined value of j'=j−k provided by subtracting the value of k from the column j indicative of a current operation state at step S8.

Otherwise, if the controller 6 decides to decrease the compressor capacity by a predetermined value of k at step S4 at step S4, it determines whether the value of j+k (where j is a column indicating a current operation state, and k is the number of changed compressors) is equal to or higher than the number of n of overall compressors at step S9. If the value of j+k is equal to or higher than the number of n at step S9, the controller 6 sets the changed column (j') to the sum of the column (j) indicating the current operation state and the number (k) of changed compressors as denoted by j'=j+k at step S10. If the value of j+k is less than the number of n, the controller 6 sets the changed column (j') to the number n of compressors as denoted by j'=n at step S11.

Thereafter, the controller 6 recognizes a numerical value corresponding to the changed position in the above-mentioned two-dimensional matrix according to the row (i') and column (j') changed at the above steps S2~S3 at step S12, and changes operation and stop states of the first to fourth compressors 1, 2, 3, and 4 to other states according to the recognized numerical value at step S13.

For example, if a reference temperature is set to 25° C. in the airconditioner including 4 compressors 1~4, and the temperature sensor 5 detects a room temperature higher than 29° C., the controller 6 operates all four compressors 1~4. If the room temperature is maintained between 27° C. and 28° C. because the airconditioner is operated as stated above, the controller 6 decides to operate only three compressors from among 4 compressors at step S1. This situation is denoted by a predetermined binary number of 11112 at step S2. When searching for the position of the binary number of 11112 from among the two-dimensional matrix shown in FIG. 4, this situation is denoted by i=0 and j=4 at step S3. In this case, the controller 6 receives a signal for subtracting one compressor from four compressors at step S4, such that an equation of i'=0+1=1 is provided at step S6 and the other equation of j'=4−1=3 is provided at step S8. The controller 6 recognizes a predetermined number of 01112 corresponding to the changed row and column (i'=1) and (j'=3) at step S12, and stops the operating compressor 1 (i.e., the first compressor 1) according to the recognized number of 01112 at step S13.

Subsequently, if the room temperature is maintained between 26° C. and 27° C. such that another compressor must stop operation, a row (i'=2) and a column (j'=2) can be obtained using the same method as the aforementioned method, and a binary number of 00112 is determined by the two-dimensional matrix shown in FIG. 4, such that the controller 6 stops the operating compressor 2 (i.e., the second compressor 2) according to the determined number of 00112. Further, if the room temperature is maintained between 25° C. and 26° C. such that yet another compressor must stop operation, a row (i'=3) and a column (j'=1) can be obtained using the same method as the aforementioned method, a binary number of 00012 is determined by the two-dimensional matrix shown in FIG. 4, and the controller 6 stops the operating compressor 3 (i.e., the third compressor 3) according to the determined number of 00112, such that the controller 6 operates only the fourth compressor 4. If the room temperature is equal to or less than 25° C., the controller 6 obtains a row (i'=0) and a column (j'=0), such that it stops all the compressors.

Then, if the room temperature is abruptly increased to 26° C., and indoor load is increased such that only one compressor must be operated, the controller 6 decides to operate one of four compressors 1~4 at step S1. If the above situation is denoted by a binary number, a binary number of 00002 is created at step S2. When searching for the position of the binary number of 00002 from among the two-dimensional matrix shown in FIG. 4, this situation is denoted by i=0 and j=0 at step S3. In this case, the controller 6 receives a signal for operating one compressor at step S4, such that an equation of j+k=0+1=1 is provided and the sum of j and k is less than n=4 at step S9, resulting in j'=j+k=0+1=1 at step S10. The controller 6 recognizes a predetermined number of 10002 corresponding to the changed row and column (i'=i=0) and (j'=1) at step S12, and operates the first compressor 1 in a stationary state according to the recognized number of 10002 at step S13. If the room temperature is abruptly increased to 28° C., the controller 6 decides to operate only two compressors from among the second to fourth stationary compressors 2~4. In this case, a row (i'=0) and a column (j'=3) can be obtained using the aforementioned method, such that the second and third compressors 2 and 3 are additionally operated.

The present invention is not limited to the aforementioned preferred embodiments and drawings, may change the above two-dimensional matrix table to another matrix table configured in the form of O and X characters for an airconditioner including N compressors, may apply the changed matrix table to the airconditioner, and may change element arrangement of the matrix to another arrangement as necessary. Also, the present invention may change the order for changing row and column arrangement of the two-dimensional matrix to another order as necessary.

As apparent from the above description, an apparatus and method for controlling multiple compressors for use in an airconditioner according to the present invention sequentially and equally operates N compressors using a predetermined matrix which prevents only a specific compressor from among the N compressors from being repeatedly operated, arranges rows and columns of the matrix to allow all compressors to be alternately operated according to the number of operating compressors from among all compressors, and stochastically operates and stops the N compressors using the matrix. As a result, the present invention controls the N compressors to be equally operated without overlapping operation times of the N compressors, and alleviates fatigue of the compressors, such that the N compressors have equally longer lifetimes.

The matrix is a two-dimensional matrix, such that operation times of the N compressors can be easily combined with each other.

Operation states of operating compressors and stop states of stationary compressors are denoted by a number of ciphers of a binary number equal to a serial number of each compressor. The operating compressor is denoted by '1', and the stationary compressor is denoted by '0' in such a way that a binary number having N ciphers indicates the operation and stationary compressors. Elements of the two-dimensional matrix can be obtained by converting a numerical value acquired by a generalized equation denoted by the sum of progressions into a binary number, such that a two-dimensional matrix can be easily configured when N compressors are operated.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The present disclosure relates to subject matter contained in Korean Application No. 10-2004-0038221, filed on May 28, 2004, the contents of which are herein expressly incorporated by reference in its entirety.

What is claimed is:

1. A method for controlling multiple compressors for use in an air conditioner, comprising:

sequentially and equally operating a total number of compressors according to a matrix defined to prevent a specific compressor from among the total number of compressors from being repeatedly operated in sequence;

deciding to increase or decrease capacity of the operating compressors by a predetermined value such that a certain number of compressors are added to or subtracted from the total number of compressors;

changing a position in a matrix including one or more numbers indicative of a current operation state to another position according to the predetermined value; and changing operation states of the total number of compressors to other states according to a number located at the changed matrix position, wherein the matrix comprises a two-dimensional matrix, and wherein rows and columns of the matrix are arranged to control the total number of compressors to be alternately operated according to operating compressors from among the total number of compressors, and wherein elements of the two-dimensional matrix are obtained by converting a numerical value acquired by the following expression into a binary number, $$Xij=\text{sum from } \{k=1\} \text{ to } \{j\} \{2^{n-a}\},$$

if $k+1 \leqq n$, then $a=k+i$, and else if $k+1>n$, then $a=(k+i)-n$, and if $j=0$, then $Xij=0$ wherein n=the total number compressors in a system, i=row, j=column, k=a quantity of change to compressor capacity, and Xij/=compressor operation value at matrix position row i and column j.

2. The method according to claim 1, wherein the matrix including one or more numbers indicative of the current operation state comprises a two-dimensional matrix including a plurality of rows from 0 to n−1 and a plurality of columns from 0 to n.

3. The method according to claim 1, wherein when the capacity of the operating compressors must be increased by the predetermined value such that a certain number of compressors we added to the total number of n compressors, determining the changed position of the matrix by increasing a column value from an initial position by the predetermined value.

4. The method according to claim 1, wherein when the capacity of the operating compressors must be decreased by the predetermined value such that a certain number of compressors can be subtracted from the total number of n compressors, determining the changed position of the matrix by increasing a row value by 1 and decreasing a column value by the predetermined value based on an initial position.

5. The method according to claim 1, wherein operation states of the operating compressors and stop states of stationary compressors are denoted by cipher information of a binary number equal to a serial number of each compressor, each of the operating compressors is denoted by '1', and each of the stationary compressors is denoted by '0' in such a way that a binary number having a predetermined number of ciphers indicates the operation and stationary compressors.

* * * * *